United States Patent [19]

Nitschmann et al.

[11] Patent Number: 4,554,853

[45] **Date of Patent: * Nov. 26, 1985**

[54] SAFETY ARRANGEMENT FOR A SAW CHAIN OF A POWER-DRIVEN CHAIN SAW

[75] Inventors: Karl Nitschmann, Schorndorf; Hans Dolata; Günter Dietzsch, both of Waiblingen, all of Fed. Rep. of Germany

[73] Assignee: Andreas Stihl, Waiblingen, Fed. Rep. of Germany

[ * ] Notice: The portion of the term of this patent subsequent to Oct. 18, 2000 has been disclaimed.

[21] Appl. No.: 541,301

[22] Filed: Oct. 12, 1983

Related U.S. Application Data

[63] Continuation-in-part of Ser. No. 226,731, Jan. 21, 1981, Pat. No. 4,409,874.

[30] Foreign Application Priority Data

Jan. 22, 1980 [DE] Fed. Rep. of Germany ..... 3002138

[51] Int. Cl.[4] ..... B27B 17/00; B27B 33/14

[52] U.S. Cl. ..... 83/522; 83/834

[58] Field of Search ..... 83/830–834, 83/522

[56] References Cited

U.S. PATENT DOCUMENTS 1,949,670 3/1934 Winters ..... 188/1.11 X
3,587,516 6/1971 Wainscott ..... 188/1.11
3,696,692 10/1972 Baranowski ..... 83/830

FOREIGN PATENT DOCUMENTS 742935 9/1966 Canada ..... 83/830
3002138 7/1981 Fed. Rep. of Germany ..... 83/522

*Primary Examiner*—James M. Meister
*Attorney, Agent, or Firm*—Walter Ottesen

[57] ABSTRACT

The invention is directed to a safety arrangement for a saw chain which includes cutting links. A first safety mark is formed in the outside surface of the upwardly-extending portion of the rearmost wall of the cutting link. This first safety mark is disposed at a predetermined distance from the trailing edge of the cutting link and extends in a direction substantially parallel thereto. A second safety mark is formed in the wall of the depth limiter and extends from the leading edge of the cutting link to a notch between the depth limiter and the cutting tooth. The second safety mark is disposed at a predetermined distance below the engaging edge of the limiter. The first safety mark defines the rearmost position to which the blade and the upwardly-extending portion of the cutting tooth can be safely worn provided that the engaging edge of the depth limiter has not been worn down to an elevation below the second safety mark whereby the marks provide positive visual indications to an operator when further use of the saw chain would be unsafe.

16 Claims, 8 Drawing Figures

SAFETY ARRANGEMENT FOR A SAW CHAIN OF A POWER-DRIVEN CHAIN SAW

COPENDING APPLICATION

This application is a continuation-in-part application of copending patent application Ser. No. 226,731 filed on Jan. 21, 1981 and which issued on Oct. 18, 1983 as Pat. No. 4,409,874 entitled "Saw Chain For Chain Saws, Particularly Power Chain Saws."

FIELD OF THE INVENTION

The invention relates to a safety arrangement for a saw chain of a power-driven chain saw.

BACKGROUND OF THE INVENTION

The cutting and non-cutting links making up a saw chain of a power-driven chain saw are worn down because of use. The cutting links are, in addition, also worn away by repeated sharpening of the cutting edge and filing down of the depth limiter. The links of the chain such as the cutting links and the connecting links are also worn at the lower horizontal edges thereof as they move along the guide bar of the chain saw and are engaged by the drive sprocket thereof.

With known saw chains, the operator cannot accurately determine if the wear of the individual chain links, and hence of the entire chain, has reached the extent that operation of the power chain saw no longer is advisable because of excessive wear of the chain links. This is also true for saw chains wherein the cutting links are resharpened manually or by means of a sharpening device fastened on the power saw.

As a consequence of such wear, accidents repeatedly occur during work with known power-driven chain saws because of failure of the saw chains. Frequently this results from the fact that the operator applies increased advancing pressure to a dull chain, as a result of which great wear occurs along the underside of the cutting links, and in the extreme situation can lead to wearing away of the material down to the rivets which connect the chain links with each other. In such a case, the profile or section of the respective chain links is weakened all the way to the rivet bore so that cracks form which subsequently lead to failure of the chain.

The same disadvantage can arise due to depth limiters which are filed down to such an extent by the operator of the chain saw that it is at an elevation which is no longer safe for the cutting tooth associated therewith.

A further cause of chain failure is the wear caused by the chain drive sprocket, the teeth of which mesh in openings along the underside of the chain links, particularly the cutting links, and transmit the drive torque to these chain links. This is also true for the connecting links located adjacent the cutting links.

Additionally, injuries to the chain saw operator can occur if the remainder of the cutting teeth tear off where such teeth have been worn to the point where they have insufficient strength to withstand the cutting load applied thereto.

SUMMARY OF THE INVENTION

It is an object of the invention to avoid these disadvantages of known saw chains which influence the safe operation of the power-driven chain saw and to provide a safety arrangement for the saw chain which will enable the operator to easily recognize the saw chain has been worn to the point beyond which a further use thereof would be unsafe.

The safety arrangement of the invention is for the saw chain of a chain saw such as a power-driven chain saw or the like. The saw chain includes a plurality of cutting links, a plurality of connecting links, and a plurality of driving links pivotally interconnected to define the saw chain. Each of the cutting links is formed as a body including: a rearward wall having an upwardly-extending portion and a bent-over top portion defining the blade of the cutting link, the top portion extending in a direction substantially transversely to the upwardly-extending portion to conjointly define therewith an inside angle. The upwardly extending wall portion and the top portion having respective outside surfaces facing away from the inside angle. The cutting link further includes a forward upwardly-extending wall defining the depth limiter of the cutting link. The depth limiter has a top engaging edge for engaging the work to be cut by the saw chain and this top edge of the depth limiter is at an elevation lower than the blade whereby the depth limiter limits the depth of cut of the blade and the cutting load which can be applied to the blade and the upwardly-extending portion of the rearward wall. The walls conjointly define a notch formed in the body of the cutting link thereby placing the blade in spaced relationship to the depth limiter. The body of the cutting link is bounded by a leading edge which is defined by the foremost edge of the depth limiter and a trailing edge defined by the rearmost edge of the rearward wall, the leading and trailing edges facing respectively into and away from the direction of travel of the cutting link.

The safety arrangement includes as a feature a first safety mark formed in the outside surface of the upwardly-extending portion of the rearmost wall, said first safety mark being disposed at a predetermined distance from the trailing edge and extending in a direction substantially parallel thereto. A second safety mark is formed in the wall of the depth limiter and extends from the leading edge to the notch at a predetermined distance below the engaging edge thereof. The first safety mark defines the rearmost position to which said blade and said upwardly-extending portion can be safely worn provided that the engaging edge of the depth limiter has not been worn down to an elevation below said second safety mark whereby said marks provide positive visual indications to an operator when further use of the saw chain would be unsafe.

Thus, the safety arrangement of the invention provides two markings which cooperate to provide a definitive visual indication to the operator when further use of the saw chain would be unsafe.

When the removal of material of the cutting link by wear and/or sharpening has advanced so far that the safety marking is reached, then the operator of the chain saw can easily recognize that further use of the saw chain would be unsafe and should be avoided.

The safety marks are applied to the cutting link as described above and may be machined out of the material of the chain link, and in a preferred embodiment of the invention, the marks can be in the form of a groove. Alternatively, the marks can be in the form of a bead. In this connection, it is particularly advantageous if the beads or grooves are impressed or ground into the main body of the chain links of the saw chain. However, it is also possible by thermal treatment of the chain links to also make the safety marking in color, and particularly, by laser beams or by spark arcing, to make the safety markings in such a manner that they remain readily recognizable even after long use.

According to another embodiment of the invention, the above-mentioned first safety mark can be applied to the cutting tooth so that it is formed in the top surface of the bent-over top portion substantially parallel to the cutting edge. If desired, this first safety mark can be extended to run from the top surface down the outside surface of the upwardly-extending portion of the rearmost wall. The extended portion of the first safety mark is disposed at a predetermined distance from the trailing edge of the cutting link and runs in a direction substantially parallel thereto.

BRIEF DESCRIPTION OF THE DRAWING

The invention will now be described with reference to the drawing wherein.

DESCRIPTION OF THE PREFERRED EMBODIMENTS OF THE INVENTION

Figure 1:
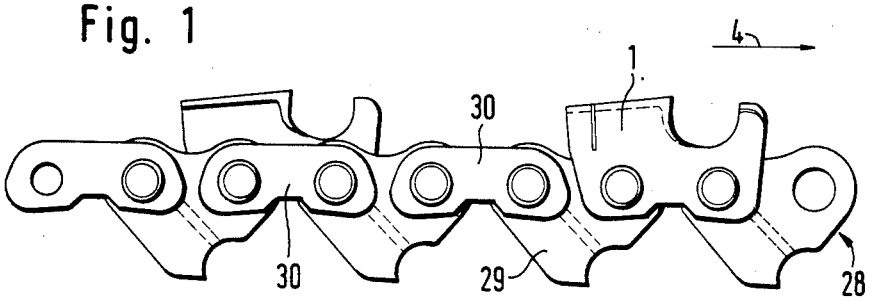
FIG. 1 is a side elevation view of a saw chain equipped with the safety arrangement of the invention.
Figure 2:
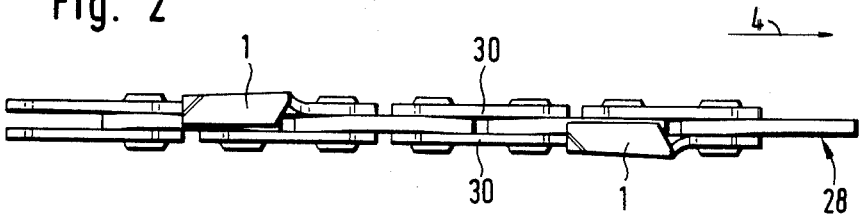
FIG. 2 is a plan view of the saw chain of FIG. 1.

FIGS. 1 and 2 illustrate a saw chain equipped with the safety arrangement of the invention. The saw chain 28 includes cutting links 1 of the kind shown in FIGS. 3 to 5 and connecting links of the kind shown in FIG. 8 as well as drive links 29. The cutting links are arranged in the saw chain as lefthand and righthand side links. The saw chain runs on the cutter bar of a chain saw (not shown) in the direction of arrow 4.

Figure 3:
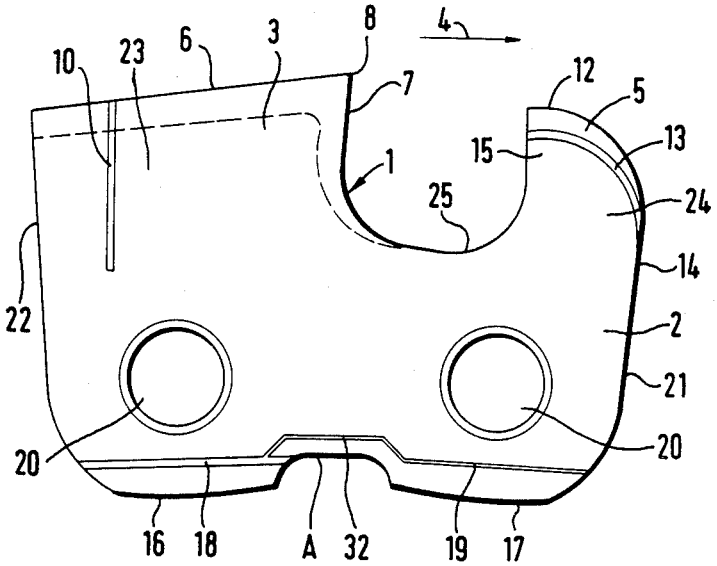
FIG. 3 is a side elevation of a cutting link of the saw chain equipped with safety marks according to an embodiment of the invention.
Figure 4:
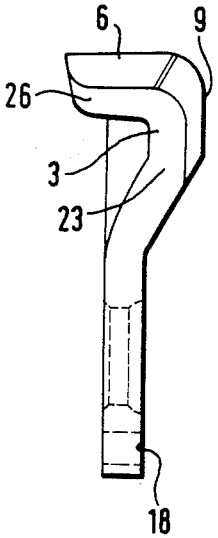
FIG. 4 is a rear elevation view of the cutting link shown in FIG. 3.
Figure 5:
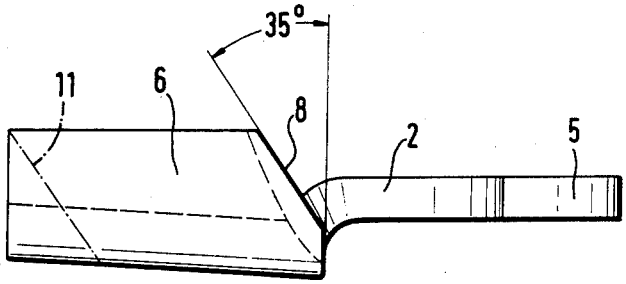
FIG. 5 is a plan view of the cutting link of FIG. 3.

Referring now to FIGS. 3 to 5, the cutting member or cutting link 1 is reproduced in a scale enlarged approximately by a factor of five and has a flat main body 2 on which a cutting part or cutting tooth 3 is formed by stamping and bending. The saw chain includes a plurality of cutting links and, when viewed in the direction of movement of the saw chain as indicated by arrow 4, the cutting tooth 3 is located behind a depth limiter 5. The front part of the depth limiter 5 is rounded off, and the depth limiter itself, in contrast to the cutting tooth 3 extends in the same plane as the base body 2. The body 2 of the cutting link has a leading edge 21 (the righthand edge of FIG. 3) and a trailing edge 22 (the lefthand edge of FIG. 1) as well as leading and trailing round holes 20 for receiving connecting rivets.

In order to maintain or reestablish the desired high cutting capacity, the tooth top 6 and the tooth face 7 of the cutting link 1 are conventionally refiled with a round file in such a way that a sharp cutting edge 8 results. This cutting edge 8 extends at an angle of approximately 35° transversely to the longitudinal direction of movement of the cutting link as shown in FIG. 5.

To indicate to the user of the power-driven chain saw, and to advise when further use of the saw chain is no longer safe, several marks 10, 11 and 13 are provided on the cutting link 1. These safety marks are arranged in combination with each other.

The cutting link 1 is provided with a first safety mark 10 formed on the outside surface 9 of the upwardly-extending portion of the rearmost wall 23 of the body 2. The mark 10 extends upwardly to the top surface 6 of the bent-over top portion 26 defining the blade of the cutting link. As FIG. 3 shows, the mark 10 is disposed at a predetermined distance from the trailing edge 22 and extends in a direction substantially parallel thereto.

The mark 10 can be a groove which can be formed by milling, grinding or by stamping. The base of the groove can be rounded out to avoid a notch effect.

According to another embodiment of the invention, the first safety mark can be formed in the top surface 6 of the bent-over top portion 26 of the cutting tooth 3 and extends in a direction substantially parallel to the cutting edge 8 as shown by broken line 11 in FIG. 5.

If desired, the first safety mark can be configured as a continuous line made up of segments 10 and 11. The safety mark 10 preferably extends to just above the rivet hole 20 next to the trailing edge 22.

The cutting link 1 shown in FIGS. 3 to 5 includes a forward upwardly-extending wall 24 defining the depth limiter 5. The depth limiter 5 defines how deep the cutting tooth 3 can cut the wood and therefore what load will be applied to the cutting tooth. If this load is excessive, the cutting tooth 3 can break off and thereby constitute a safety hazard to the operator of the chain saw. Accordingly, the height of the depth limiter must be adapted by wear and/or grinding to the particular height of the associated cutting tooth 3.

A second safety mark 13 is formed in the surface 15 of wall 24. The mark 13 extends from the leading edge 21 to the notch 25 at a predetermined distance below the engaging surface 12. In the illustrated embodiment, the mark 13 is a notch or groove and can be placed on one or both sides of the depth limiter 5.

The first safety mark defines the rearmost position to which the blade 26 and the upwardly-extending portion 23 making up the cutting tooth 3 can be safely worn provided that the engaging edge 12 of the detph limiter 5 has not been worn down to an elevation below the second safety mark 13 whereby the first safety mark 10 and/or 11 and second safety mark 13 conjointly provide positive visual indications to an operator when further use of the saw chain would be unsafe.

Figure 6:
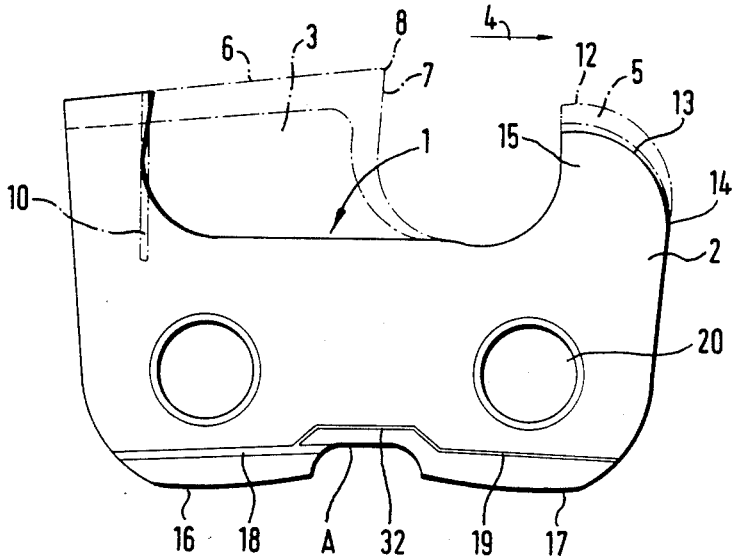
FIG. 6 is a side elevation view of a cutting link where the cutting tooth and depth limiter have been worn away to the respective safety marks thereon.
Figure 7:
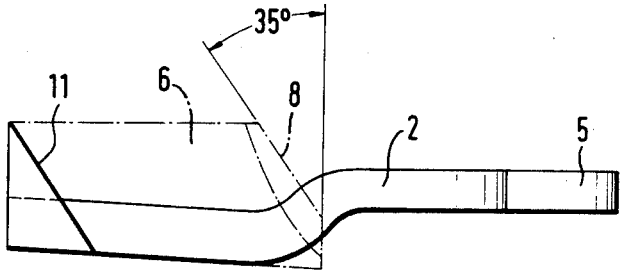
FIG. 7 is a plan view of a cutting link of FIG. 6.

FIGS. 6 and 7 show the cutting link 1 with the cutting tooth 3 and depth limiter 5 worn down to the first and second safety marks 10 and 13, respectively, whereby the safety arrangement of the invention provides a positive visual indication that the saw chain is unsafe and that work therewith should be discontinued.

During the sawing operation, the base portions of the cutting links and of the connecting links become worn thereby reducing the material of the link at the region of the rivet holes. If the wear at the base region becomes excessive, a rivet can tear out causing the saw chain to break thereby constituting a danger to the operator.

Figure 8:
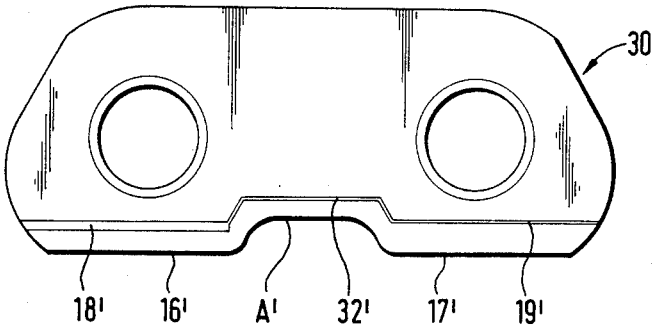
FIG. 8 is a connecting link of the saw chain of FIGS. 1 and 2 equipped with safety marks according to still another embodiment of the invention.

Accordingly, a third safety marking including one or more marks at the base region of the cutting link can be provided. If desired, the third safety marking can also include like marks on the connecting links. More specifically, the third safety marking can include marks 18 and/or 19 on the cutting link as shown in FIG. 3 and marks 18' and/or 19' on the connecting link 30 as shown in FIG. 8. These marks 18 and 19 are preferably parallel to the base edges 16 and 17 of the cutting link. Likewise, marks 18' and 19' of the connecting link 30 extend parallel to base edges 16' and 17'.

Referring again to FIG. 3, a mark 32 can be provided above recess A between the marks 18 and 19. Similarly, in FIG. 8, mark 32' can be provided above recess A'. The recesses A and A' are provided for the engagement of the teeth of the chain drive sprocket (not shown) which transmits the drive torque to the chain links. The teeth of the chain drive sprocket cause considerable wear to occur at this region of the cutting and connecting links so that the marks 32 and 32' provide an indication of wear at this location.

The safety marks can be in color or can be emphasized by means of inserted chrome strips. It is also generally sufficient if the safety marks are shiny and in this manner distinguishable from their immediate surroundings.

It is understood that the foregoing description is that of the preferred embodiments of the invention and that various changes and modifications may be made thereto without departing from the spirit and scope of the invention as defined in the appended claims.

What is claimed is:

1. A safety arrangement for the saw chain of a chain saw such as a power-driven chain saw or the like, the saw chain including a plurality of cutting links, a plurality of connecting links, and a plurality of driving links pivotally interconnected to define the saw chain, each of the cutting links being a body including: a rearward wall having an upwardly-extending portion and a bent-over top portion defining the blade of the cutting link, the top portion extending in a direction transversely to the upwardly-extending portion to conjointly define therewith an inside angle, the upwardly-extending wall portion and the top portion having respective outside surfaces facing away from said inside angle; and, a forward upwardly-extending wall defining the depth limiter of the cutting link, the depth limiter having a top engaging edge for engaging the work to be cut by the saw chain, the top edge of the depth limiter being at an elevation lower than the blade whereby the depth limiter limits the depth of cut of the blade and the cutting load which can be applied to the blade and the upwardly-extending portion of the rearward wall; the walls conjointly defining a notch formed in the body thereby placing the blade in spaced relationship to the depth limiter; the body being bounded by a leading edge defined by the foremost edge of the depth limiter and a trailing edge defined by the rearmost edge of the rearward wall, the leading and trailing edges facing respectively into and away from the direction of travel of the cutting link; the safety arrangement comprising:

a first safety mark formed in the outside surface of said upwardly-extending portion and across said bent-over top portion of said rearward wall, said first safety mark defining a line disposed at a predetermined distance from said trailing edge and extending in a direction substantially parallel thereto;

a second safety mark formed in the wall of the depth limiter and extending from the leading edge to the notch at a predetermined distance below said engaging edge;

said first safety mark defining the rearmost position to which said blade and said upwardly-extending portion can be safely worn provided that the engaging edge of the depth limiter has not been worn down to an elevation below said second safety mark whereby said marks provide positive visual indications to an operator when further use of the saw chain would be unsafe; and, visual accentuating means formed on said safety marks for marking the same easily recognizable by the operator of the chain saw equipped with said saw chain.

2. The safety arrangement of claim 1 wherein said bent-over top portion extends in a direction substantially perpendicular to said upwardly-extending portion to conjointly define therewith an inside angle of approximately ninety degrees.

3. The safety arrangement of claim 1, said first and second safety marks being formed as grooves in said outside surface of said upwardly-extending portion and said wall of said depth limiter, respectively.

4. The safety arrangement of claim 1, said visual accentuating means being a shiny surface formed on said marks.

5. The safety arrangement of claim 1, said visual accentuating means being a color material formed on said marks.

6. The safety arrangement of claim 3, said visual accentuating means being chrome strips inserted in said grooves, respectively.

7. A safety arrangement for the saw chain of a chain saw such as a power-driven chain saw or the like, the saw chain including a plurality of cutting links, a plurality of connecting links, and a plurality of driving links pivotally interconnected to define the saw chain, each of the cutting links being a body including: a rearward wall having an upwardly-extending portion and a bent-over top portion defining the blade of the cutting link, the top portion extending in a direction transversely to the upwardly-extending portion to conjointly define therewith an inside angle, the upwardly-extending wall portion and the top portion having respective outside surfaces facing away from said inside angle; and, a forward upwardly-extending wall defining the depth limiter of the cutting link, the depth limiter having a top engaging edge for engaging the work to be cut by the saw chain, the top edge of the depth limiter being at an elevation lower than the blade whereby the depth limiter limits the depth of cut of the blade and the cutting load which can be applied to the blade and the upwardly-extending portion of the rearward wall; the walls conjointly defining a notch formed in the body thereby placing the blade in spaced relationship to the depth limiter; the body being bounded by a leading edge defined by the foremost edge of the depth limiter and a trailing edge defined by the rearmost edge of the rearward wall, the leading and trailing edges facing respectively into and away from the direction of travel of the cutting link;

each of the cutting links and each one of the connecting links have base edges at which wear occurs during the movement of the saw chain along the cutter bar, the safety arrangement comprising:

a first safety mark formed in the outside surface of said upwardly-extending portion of said rearmost wall, said first safety mark defining a line disposed at a predetermined distance from said trailing edge and extending in a direction substantially parallel thereto;

a second safety mark formed in the wwall of the depth limiter and extending from the leading edge to the notch at a predetermined distance below said engaging edge;

said first safety mark defining the rearmost position to which said blade and said upwardly-extending portion can be safely worn provided that the engaging edge of the depth limiter has not been worn down to an elevation below said second safety mark whereby said marks provide positive visual indications to an operator when further use of the saw chain would be unsafe; and, a third safety mark formed in the base region of at least one of said links, said third safety mark extending in a direction substantially parallel to the base edge corresponding to said base region for likewise providing a positive visual indication to the operator when further use of the saw chain would be unsafe.

8. The safety arrangement of claim 7, comprising visual accentuating means formed on said safety marks for making the same more easily recognizable by the operator of the chain saw equipped with said saw chain.

9. A safety arrangement for the saw chain of a chain saw such as a power-driven chain saw or the like, the saw chain including a plurality of cutting links, a plurality of connecting links, and a plurality of driving links pivotally interconnected to define the saw chain, each of the cutting links being a body including: a rearward wall having an upwardly-extending portion and a bent-over top portion defining the blade of the cutting link, the blade having a cutting edge inclined at a predetermined angle with respect to the direction of movement of the saw chain, the top portion extending in a direction transversely to the upwardly-extending portion to conjointly define therewith an inside angle, the upwardly-extending wall portion and the top portion having respective outside surfaces facing away from said inside angle; and, a forwawrd upwardly-extending wall defining the depth limiter of the cutting link, the depth limiter having a top engaging edge for engaging the work to be cut by the saw chain, the top edge of the depth limiter being at an elevation lower than the blade whereby the depth limiter limits the depth of cut of the blade and the cutting load which can be applied to the blade and the upwardly-extending portion of the rearward wall; the walls conjointly defining a notch formed in the body thereby placing the blade in spaced relationship to the depth limiter; the body being bounded by a leading edge defined by the foremost edge of the depth limiter and a trailing edge defined by the rearmost edge of the rearward wall, the leading and trailing edges facing respectively into and away from the direction of travel of the cutting link; the safety arrangement comprising:

a first safety mark extending across the top surface of said bent-over top portion and inclined so as to be substantially parallel to said cutting edge;

a second safety mark formed in the wall of the depth limiter and extending from the leading edge to the notch at a predetermined distance below said engaging edge;

said first safety mark defining the rearmost position to which said blade and said upwardly-extending portion can be safely worn provided that the engaging edge of the depth limiter has not been worn down to an elevation below said second safety mark whereby said marks provide positive visual indications to an operator when further use of the saw chain would be unsafe; and, visual accentuating means formed on said safety marks for making the same easily recognizable by the operator of the chain saw equipped with said saw chain.

10. The safety arrangement of claim 9, said first safety mark being extended to run from said top surface down the outside surface of said upwardly-extending portion of said rearward wall, said extending portion of said safety mark being disposed at a predetermined distance from said trailing edge and running in a direction substantially parallel thereto.

11. The safety arrangement of claim 9, said first and second safety marks being formed as grooves in said top surface and said wall of said depth limiter, respectively.

12. The safety arrangement of claim 9, said visual accentuating means being a shiny surface formed on said marks.

13. The safety arrangement of claim 9, said visual accentuating means being a color material formed on said marks.

14. The safety arrangement of claim 11, said visual accentuating means being chrome strips inserted in said grooves, respectively.

15. A safety arrangement for the saw chain of a chain saw such as a power-driven chain saw or the like, the saw chain including a plurality of cutting links, a plurality of connecting links, and a plurality of driving links pivotally interconnected to define the saw chain, each of the cutting links being a body including: a rearward wall having an upwardly-extending portion and a bent-over top portion defining the blade of the cutting link, the blade having a cutting edge inclined at a predetermined angle with respect to the direction of movement of the saw chain, the top portion extending in a direction transversely to the upwardly-extending portion to conjointly define therewith an inside angle, the upwardly-extending wall portion and the top portion having respective outside surfaces facing away from said inside angle; and, a forward upwardly-extending wall defining the depth limiter of the cutting link, the depth limiter having a top engaging edge for engaging the work to be cut by the saw chain, the top edge of the depth limiter being at an elevation lower than the blade whereby the depth limiter limits the depth of cut of the blade and the cutting load which can be applied to the blade and the upwardly-extending portion of the rearward wall; the walls conjointly defining a notch formed in the body thereby placing the blade in spaced relationship to the depth limiter; the body being bounded by a leading edge defined by the foremost edge of the depth limiter and a trailing edge defined by the rearmost edge of the rearward wall, the leading and trailing edges facing respectively into and away from the direction of travel of the cutting link;

each one of the cutting links and each one of the connecting links have base edges at which wear occurs during the movement of the saw chain along the cutter bar, the safety arrangement comprising:

a first safety mark formed in the top surface of said bent-over top portion and inclined so as to be substantially parallel to said cutting edge;

a second safety mark formed in the wall of the depth limiter and extending from the leading edge to the notch at a predetermined distance below said engaging edge;

said first safety mark defining the rearmost position to which said blade and said upwardly-extending portion can be safely worn provided that the engaging edge of the depth limiter has not been worn down to an elevation below said second safety mark whereby said marks provide positive visual indications to an operator when further use of the saw chain would be unsafe; and, a third safety mark formed in the base region of at least one of said links, said third safety mark extending in a direction substantially parallel to the base edge corresponding to said base region for likewise providing a positive visual indication to the operator when further use of the saw chain would be unsafe.

16. The safety arrangement of claim 15, comprising visual accentuating means formed on said safety marks for making the same more easily recognizable by the operator of the chain saw equipped with said saw chain.

* * * * *

UNITED STATES PATENT AND TRADEMARK OFFICE

CERTIFICATE OF CORRECTION

PATENT NO. : 4,554,853

DATED : November 26, 1985

INVENTOR(S) : Karl Nitschmann, Hans Dolata and Günter Dietzsch

It is certified that error appears in the above-identified patent and that said Letters Patent is hereby corrected as shown below:

In column 1, line 68: add -- when -- after the word "recognize".

In column 4, line 45: delete "detph" and substitute -- depth -- therefor.

In column 6, line 7: delete "marking" and substitute -- making -- therefor.

In column 6, line 57: delete "each of" and substitute -- each one of -- therefor.

In column 6, line 67: delete "wwall" and substitute -- wall -- therefor.

In column 7, line 37: delete "forwawrd" and substitute -- forward -- therefor.

Signed and Sealed this

*Eighth* Day of *July 1986*

[SEAL]

*Attest:*

DONALD J. QUIGG

*Attesting Officer*

*Commissioner of Patents and Trademarks*